United States Patent [19]

Stevens

[11] 4,337,053

[45] Jun. 29, 1982

[54] IDLE ADJUSTMENT CONTROL AND SCULPTURED TWIST GRIP THROTTLE CONTROL HANDLE FOR A MARINE PROPULSION DEVICE

[75] Inventor: Myron T. Stevens, Kenosha, Wis.

[73] Assignee: Outboard Marine Corporation, Waukegan, Ill.

[21] Appl. No.: 78,562

[22] Filed: Sep. 24, 1979

[51] Int. Cl.[3] ..... B63H 21/26

[52] U.S. Cl. ..... 440/87; 440/900; 16/111 A

[58] Field of Search ..... 115/17, 18 R, 18 E, 115/70, 6.1; 74/480 B, 485, 488, 489, 491, 492, 493, 504, 550, 551.1, 551.8, 551.9; 123/97 R, 98, 103 C; 244/234; 440/84-87, 900; 180/19 R; 16/111 A; 56/11.4

[56] References Cited

U.S. PATENT DOCUMENTS

| | | | |
|---|---|---|---|
| 2,751,799 | 6/1956 | Long | 115/17 |
| 2,754,505 | 7/1956 | Kenyon | 74/551.8 |
| 2,776,579 | 1/1957 | Nichel, Jr. | 440/87 |
| 3,922,996 | 12/1975 | Meyer | 115/18 R |
| 3,955,438 | 5/1976 | Zakrzewski | 115/18 R |
| 4,212,363 | 7/1980 | Letner | 16/111 A |

*Primary Examiner*—Edward R. Kazenske
*Assistant Examiner*—Jesús D. Sotelo
*Attorney, Agent, or Firm*—Michael, Best & Friedrich

[57] ABSTRACT

A marine propulsion device comprises a marine propulsion unit including an engine and a rotatably mounted propeller which is operatively connected with the engine. The engine has a throttle movable between an idle position and an advanced position. A steering tiller is attached to the marine propulsion unit, and a throttle grip having an exterior gripping surface is rotatably attached on the steering tiller. A throttle linkage assembly operatively connects the throttle grip with the throttle for moving the throttle between the idle position and the advanced position in response to rotation of the throttle grip. An idle adjustment assembly is carried by the throttle grip and is operatively connected with the throttle linkage assembly for adjusting the low operational engine speed above the true idle speed of the engine. A portion of the idle adjustment assembly protrudes outwardly from the sides of the exterior gripping surface to permit the operator to operate the idle adjustment assembly without removing his or her hands from the throttle grip. The gripping surface of the throttle grip is contoured to include a first surface area spaced generally at a first radial distance from the rotational axis of the throttle grip and a second surface area which is spaced angularly from the first surface area with respect to the rotational axis and generally at a second radial distance from the rotational axis which is different from the first distance. The operator is thus able to judge the approximate position of the throttle by visual and/or tactile reference to the contoured throttle grip.

3 Claims, 6 Drawing Figures

IDLE ADJUSTMENT CONTROL AND SCULPTURED TWIST GRIP THROTTLE CONTROL HANDLE FOR A MARINE PROPULSION DEVICE

FIELD OF THE INVENTION

The invention relates generally to marine propulsion devices, and more particularly, to throttle controls for marine propulsion devices. Still more particularly, the invention relates to rotatable throttle control handles or "twist grips" associated with outboard motors.

DESCRIPTION OF THE PRIOR ART

Attention is directed to control handles which are applicable for use with marine propulsion devices and which are disclosed in the following U.S. Pat. Nos.:

| | | |
|---|---|---|
| Smith | 1,804,442 | May 21, 1931 |
| Davison et al | 2,651,278 | September 18, 1953 |
| Michler | 2,826,931 | March 18, 1958 |
| Miner | 3,140,689 | July 14, 1964 |
| Mieluta | D-214,786 | July 29, 1969 |
| Malasky | D-218,602 | September 8, 1970 |
| Albertson | 3,742,928 | July 3, 1973 |
| Meyer | 3,922,996 | December 2, 1975 |
| Petty | 4,031,775 | June 28, 1977 |

Attention is likewise directed to the now pending U.S. patent application, Ser. No. 959,890, filed Nov. 13, 1978 (Edward H. DuBois), "THROTTLE CONTROL FOR A MARINE PROPULSION DEVICE"), which application is assigned to the assignee of the present invention.

SUMMARY OF THE INVENTION

The invention provides a marine propulsion device comprising a marine propulsion unit including an engine and a rotatably mounted propeller operatively connected with the engine. The engine has a throttle movable between an idle position for operating the engine at an idle speed and an advanced position for operating the engine at a speed above the idle speed. A steering tiller having a longitudinal axis is attached to the marine propulsion unit, and throttle grip means is attached to the steering tiller for rotation relative to the longitudinal axis between a first position and a second position. The throttle grip means includes a gripping surface which is contoured to include a first surface area and a second surface area. The first surface area is spaced at a given radial distance from the longitudinal axis. The second surface area is spaced angularly from the first surface area with respect to the longitudinal axis and is at a different radial distance from the longitudinal axis than the first surface area. Throttle linkage means operatively connects the throttle grip means with the throttle for moving the throttle between its idle position and its advanced position in response to movement of the throttle grip means between its first position and its second position.

In one embodiment of the invention, the radial distance between the first surface area and the longitudinal axis is larger than the corresponding radial distance between the second surface area and the longitudinal axis. Furthermore, the first surface area is angularly spaced from the second surface area by approximately 90°. Thus, a gripping surface which is generally elliptical in cross-section is defined.

In one embodiment of the invention, an idle adjustment member having an outer peripheral side edge is carried by the throttle grip means for rotation with and relative to the throttle grip means. Means operatively connects the idle adjustment member with the throttle linkage means for moving the throttle between the idle position and a range of positions slightly advanced from the idle position in response to rotation of the idle adjustment member relative to the throttle grip. A portion of the outer peripheral side edge of the idle adjustment member extends outwardly beyond the sides of the gripping surface of the throttle grip means and is thereby accessible to the operator so that the idle adjustment member may be rotated relative to the throttle grip means while the operator's hand remains on the gripping surface.

One of the principal features of the invention is the provision of a marine propulsion device having a contoured throttle control grip which permits the operator to judge the approximate position of the throttle by visual and/or tactile reference to the rotational position of the contoured throttle grip.

Another of the principal features of the invention is the provision of a marine propulsion device having a throttle control grip and an idle adjustment member which protrudes outwardly from the sides of the throttle control grip to thereby facilitate adjustment of the low operational engine speed while the operator's hand remains on the throttle control grip.

Other features and advantages of the embodiments of the invention will become apparent upon reviewing the following general description, the drawings, and the appended claims.

Figure 1:
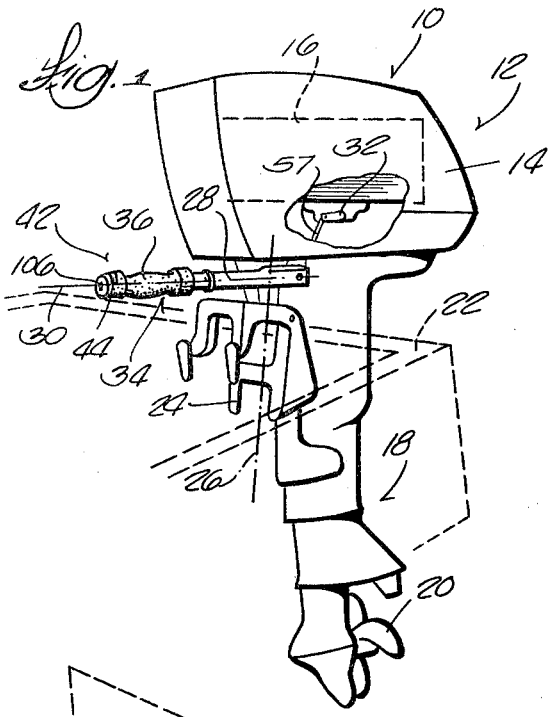
FIG. 1 is a marine propulsion device having an associated contoured throttle "twist" grip which embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also it is to be understood that the phraseology and terminology used herein for the purpose of description should not be regarded as limiting.

GENERAL DESCRIPTION

Shown in FIG. 1 is a marine propulsion device 10 which is in the form of an outboard motor. The outboard motor 10 includes a propulsion unit 12 having a power head section 14 which itself includes an engine 16, typically an internal combustion engine. The outboard motor 10 also includes a lower drive section 18 upon which a propeller 20 is rotatably mounted. The propeller 20 is operably connected by a drive train mechanism (not shown) with the engine 16.

The propulsion unit 12 is attached to the transom 22 of a boat (shown in phantom lines in FIG. 1) by a suitable swivel bracket assembly 24. The boat is steered through the water by pivoting the propulsion unit 12 on the swivel bracket assembly 24 about vertical pivot axis 26. The outboard motor 10 also includes a tubular steering handle 28, or tiller, having a longitudinal axis 30 which extends outwardly from the vertical pivot axis 26. The operator may thus steer while being seated within the boat.

The engine 16 includes a throttle 32 (shown diagrammatically in FIG. 1) for controlling the speed of the engine 16 and thereby controlling the speed of the boat through the water. The throttle 32 is movable between an idle position for operating the engine 16 at an idle speed and at an advanced position for operating the engine 16 at a speed above the idle speed. A throttle control mechanism 34 is carried by the steering handle 28 so that the operator may control the speed of the boat while steering.

In general, the throttle control mechanism 34 includes a throttle "twist" grip 36 having an exterior gripping surface 38. While the throttle grip 36 may be constructed of various materials, it is preferably made of plastic. The throttle grip 36 is attached to the steering handle 28 for rotation by the operator relative to the longitudinal axis 30 between two rotationally spaced positions (shown alternatively in solid and phantom lines in FIG. 2). Throttle linkage means 40 (see FIG. 6) operably interconnects the throttle grip 36 with the throttle 32 for moving the throttle 32 between its idle position and its advanced position in response to rotation of the throttle grip 36 between its two rotationally spaced positions.

In addition, an idle adjustment assembly 42 is carried by the throttle grip 36 for rotation with and relative to the throttle grip 36. As will be described in greater detail later herein, the idle adjustment assembly 42 is operatively connected with the throttle linkage means 40 such that rotation of the idle adjustment assembly 42 relative to the throttle grip 36 changes the low operational engine speed within a range of speeds sightly above the idle speed of the engine 16.

Figure 5:
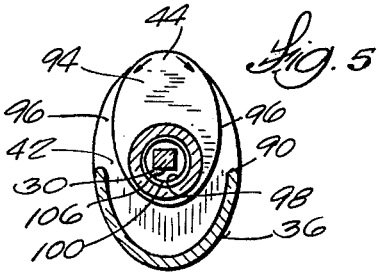
FIG. 5 is a sectional view of the contoured throttle grip showing the associated idle adjustment assembly and taken generally along line 5—5 of FIG. 3.

As can best be seen in FIG. 5, virtually all of the idle adjustment assembly 42 is enclosed within the interior of the throttle grip 36. However, a tip portion 44 of the idle adjustment assembly 42 is exposed for operator access. As will be described in greater detail later herein, the operator may thus easily rotate the idle adjustment assembly 42 relative to the throttle grip 36 and thereby adjust the low operational speed of the engine without removing his or her hands from the throttle grip 36.

Figure 2:
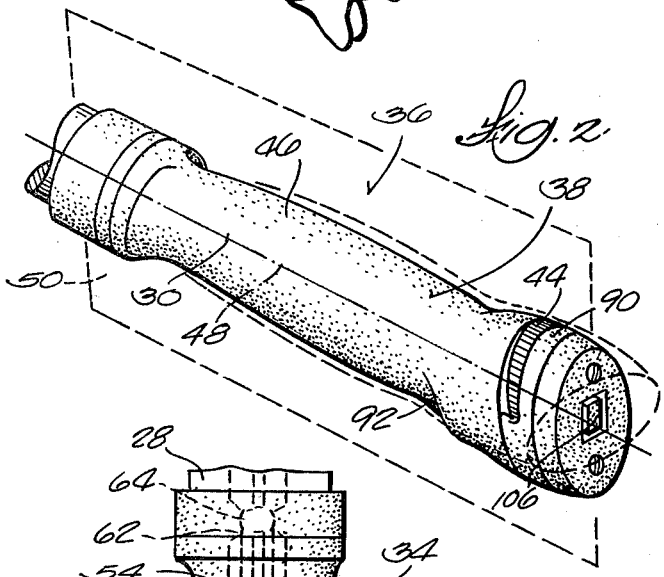
FIG. 2 is an enlarged perspective view of the contoured throttle grip shown in FIG. 1.
Figure 4:
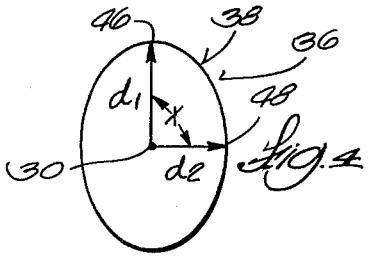
FIG. 4 is a sectional view of the contoured throttle grip taken generally along line 4—4 of FIG. 3.

In the illustrated embodiment, and as best shown in FIG. 2 and 4, the exterior gripping surface 38 of the throttle grip 36 is contoured between two angularly spaced surface areas, respectively, 46 and 48. As is best seen in FIG. 4, the first surface area 46 is spaced at a first radial distance (designated d1 in FIG. 4) from the longitudinal axis 30. The second surface area 48 is spaced angularly from the first surface area 46 with respect to the longitudinal axis 30 (as indicated by Angle X in FIG. 4) and is also spaced at a second radial distance (designated d2 in FIG. 4) from the longitudinal axis 30.

Figure 3:
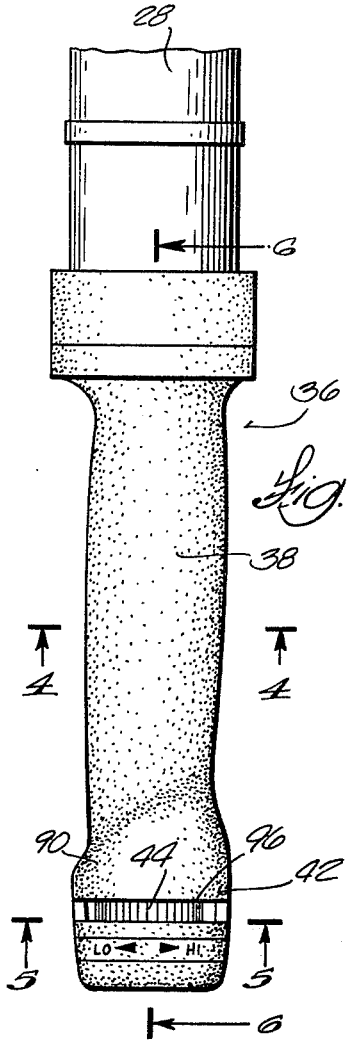
FIG. 3 is an enlarged plan view of the contoured throttle grip shown in FIG. 1.

While the exact shape of the contour between the two surface areas 46 and 48 may vary, in the illustrated embodiment (as is best shown in FIGS. 2 and 4), the first radial distance d1 is larger than the second radial distance d2, and the first surface area 46 is angularly spaced from the second surface area 48 by approximately 90°. A gripping surface 38 which is generally elliptical in cross-section is thus defined. The gripping surface 38 is preferably serrated or roughened (see FIGS. 2 and 3) to enhance the operator's grip on and thus rotation of the throttle grip 36. Various areas of the gripping surface 38 may be further sculptured about the general elliptical shape to provide a comfortable custom feel for a variety of different hand sizes.

As is shown in FIG. 2, the contoured throttle grip 36 is operatively connected with the throttle linkage means 40 such that, when the radius d1 of the first surface area 46 is located in a vertical plane 50, the first rotational position of the throttle grip 36 is defined (shown in solid lines in FIG. 2), and the throttle 32 is maintained in its idle position. Subsequent rotation of the contoured throttle grip 36 moves the throttle grip 36 to its second rotational position (as is shown in phantom lines in FIG. 2), in which the radius d2 of the second surface area 48 lies in the plane 50. The throttle is now located in its advanced position.

It should now be apparent that, by virtue of this arrangement, the operator is able to judge the approximate position of the throttle 32 between its idle and advanced positions by making visual and/or tactile reference to the relative rotational position of the contoured throttle grip 36.

The just described contoured throttle grip 36 is applicable for use with various throttle linkage assemblies. However, in the illustrated embodiment, a throttle linkage assembly similar to that disclosed in now pending application Ser. No. 959,890 is shown.

Figure 6:
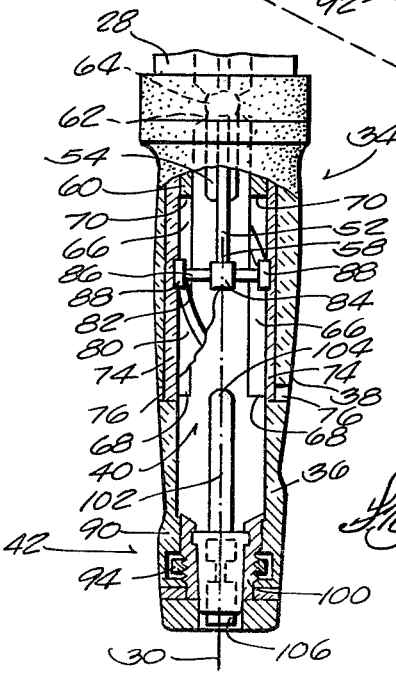
FIG. 6 is a sectional view taken generally along line 6—6 of FIG. 3.

In this construction (as is shown in FIG. 6), a throttle cable 52 is movably enclosed within a protective sleeve 54 typically made of rubber or plastic. The throttle cable 52 and sleeve 54 pass through the tubular steering handle 28, with one end 57 (see FIG. 1) being operatively connected with the throttle 32 and the opposite end 58 being operatively connected with the heretofore described throttle grip 36.

In the illustrated linkage assembly, the steering handle 28 includes an outer extension member 60 fastened upon its outermost end. An interior groove 62 on the extension member 60 mates with a shoulder 64 formed on the protective sleeve 54 of the throttle cable 52. Movement of the protective sleeve 54 within the steering handle 28 is thus prevented, while the throttle cable 52 is free to move within the sleeve 54 to displace the throttle 32 between its idle position and its advanced position. The extension member 60 also includes a pair of oppositely spaced, elongated axial slots 66 which mutually extend between generally aligned uppermost ends 68 and generally aligned lowermost ends 70.

In this construction, the throttle grip 36 is mounted on the outer extension member 60 for rotation relative to the longitudinal axis 30. An inner sleeve member 74 snugly fits within the confines of throttle grip 36 and is coupled for common rotation with the throttle grip 36 by tabs 76 which mate with holes formed in the throttle grip 36. The inner sleeve member 74 includes an interior surface portion 80 which encircles the outer extension member 60, and a helical groove 82 is formed in this interior surface portion 80. The groove 82 extends axially of the longitudinal axis 30.

A shoulder 84 is formed on the throttle grip end 58 of the throttle cable 52. A pin 86 passes through this shoulder 84. Roller bearings 88 or the like are rotatably fastened to the outer ends of the pin 86 and are in operative engagement with the helical groove 82. The pin 86 is also engaged by the slots 66 located on the outer extension member 60. The throttle grip end 58 of the throttle cable 52 is thereby restrained from rotating relative to the longitudinal axis 30 of the steering handle 28. As a result, the pin 86 moves axially between the uppermost ends 68 and lowermost ends 70 of the slots 66 as the roller bearings 88 follow the progressively advancing helical groove 82 in response to rotation of the throttle grip 36. The throttle cable 52 is thereby displaced axially of the longitudinal axis 30 of the steering handle 28 to operate the throttle.

In this construction, when the throttle grip 36 is located in its heretofore described first rotational position, with the radius d1 of the first surface area 46 in the plane 50, the pin 86 abuts against the uppermost ends 68 of the slots 66. The throttle is thus located in its idle position. Similarly, when the throttle grip 36 is located in its heretofore described second rotational position, with the radius d2 of the second surface area 48 now occupying the plane 50, the pin 86 abuts against the lowermost ends 70 of the slots 66. The throttle is thus located in its advanced position.

Referring now to the idle adjustment assembly 42 associated with the just described throttle linkage assembly, it should be appreciated that the idle adjustment assembly 42 is applicable for use in connection with various throttle control mechanisms and associated throttle grips. However, in the illustrated embodiment, the throttle grip 36 includes an enlarged end portion 90 (see FIGS. 2 and 3) which, like the contoured gripping surface 38, is generally elliptical in cross-section. The underbody of the juncture of the enlarged portion 90 with the gripping surface 38 may be sculptured to form an area 92 into which the operator may rest his or her thumb when the gripping surface 38 is grasped.

Referring now principally to FIGS. 5 and 6, the idle adjustment assembly 42 includes a generally elliptical knob 94 which is carried substantially wholly within the confines of the enlarged end portion 90 of the throttle grip 36. The elliptical knob 94 is mounted for rotatation with and relative to the throttle grip 36 about the longitudinal axis 30. The tip 44 of the knob 94 passes through a slot 96 formed in the enlarged end portion 90. In the illustrated embodiment, the slot 96 is located generally adjacent to the first surface area 46 of the contoured gripping surface 38.

The elliptical knob 94 includes therein an internally threaded hole 98 generally centered along the longitudinal axis 30. An externally threaded screw member 100 is threadably engaged in the hole 98. By virtue of this construction, operator movement of the tip portion 44 of the knob 94 within the confines of the slot 96 (as is shown by arrows in FIG. 5) and the resulting rotation of the elliptical knob 94 relative to the throttle grip 36 advances the screw member 100 axially along the longitudinal axis 30.

Referring now to FIG. 6, a stop tab member 102 projects from the underbody of the screw member 100. As the screw member 100 axially advances along the longitudinal axis 30 in response to rotation of the knob 94 relative to the throttle grip 36, the terminal end 104 of the stop tab member 102 advances into the interior of the outer extension member 60 between the slots 66.

When the terminal end 104 of the stop tab member 102 is located adjacent to the uppermost ends 68 of the slots 66 and between the uppermost ends 68 and the lowermost ends 70, the shoulder 84 will make abutting contact with the stop tab terminal end 104 before the pin 86 reaches the uppermost slot ends 68. The axial displacement of the throttle cable 52 from the advanced throttle position toward the idle throttle position is thereby halted before the actual idle position is reached. As a result, a new and slightly advanced first rotational position is defined at which a slightly advanced idle speed occurs. The rotation of the elliptical knob 94 is thus operative for selecting a range of low operational speeds slightly greater than the true idle speed of the engine 16.

A switch 106 (shown diagrammatically in FIG. 6) may be carried within the axially movable screw member 100. The switch 106 can be electrically interconnected by suitable means (not shown) extending through the tubular steering handle 28 with the ignition circuit of the engine 16 (also not shown) so that operation of the switch 106 will electrically ground the ignition circuit and thus "kill" the engine 16. As can be seen in the drawings, the operative portion of the switch 106 is slightly recessed within the enlarged end portion 90 of the throttle grip 36 to prevent accidental depression of the switch 106 and the resulting inadvertent "killing" of the engine 16.

As should now be apparent, the throttle control mechanism 34 as just described permits the operator to be seated for steering within the boat and from this seated position control a variety of engine operations without removing his or her hand from the throttle grip 36. More particularly, with his or her hand remaining in place upon the throttle grip 36, the operator is able to "twist" the throttle grip 36 to operate the throttle 32 and control the speed of the boat through the water, to quickly judge the relative location of the throttle by referring to the contoured throttle grip 36, to rotate the knob 94 to adjust the low operational speed of the engine, and to quickly terminate engine operation by operation of the recessed switch 106.

Various features of the invention are set forth in the following claims.

I claim:

1. A marine propulsion device comprising a marine propulsion unit including an engine having a throttle movable between an idle position for operating said engine at an idle speed, an advanced position for operating said engine at a speed above the idle speed, and an advanced idle position adjacent to said idle position and between said idle position and said advanced position for operating said engine at a speed above the idle speed, said marine propulsion unit further including a rotatably mounted propeller operatively connected with said engine, a steering tiller attached to said marine propulsion unit and having a longitudinal axis, a throttle grip having an outer peripheral gripping surface extending axially of said longitudinal axis, said throttle grip being attached to said steering tiller for rotation relative to said longitudinal axis between a first position and a second position, throttle linkage means operatively connected with said throttle grip and said throttle for moving said throttle between said idle position and said advanced position in response to movement of said throttle grip between said first position and said second position, an idle adjustment knob having an outer peripheral side edge and being carried by said throttle grip for rotation with and relative to said throttle grip with a portion of said outer peripheral side edge extending radially from said longitudinal axis and outwardly beyond said outer peripheral gripping surface, and means operatively connecting said idle adjustment knob with said throttle linkage means for moving said throttle between said idle position and said advanced idle position in response to rotation of said idle adjustment knob relative to said throttle grip.

2. A marine propulsion device according to claim 1 wherein said outer peripheral gripping surface of said throttle grip is contoured to include a first gripping surface area spaced generally at a first radial distance from said longitudinal axis and a second gripping area spaced angularly from said first gripping surface area with respect to said longitudinal axis and generally at a second radial distance from said longitudinal axis different from said first distance.

3. A marine propulsion device comprising a marine propulsion unit including an engine having a throttle movable between an idle position for operating said engine at an idle speed, an advanced position for operating said engine at a speed above the idle speed, and an advanced idle position adjacent to said idle position and between said idle position and said advanced position for operating said engine at a speed above the idle speed, said marine propulsion unit further including a rotatably mounted propeller operatively connected with said engine, a steering tiller attached to said marine propulsion unit and having a longitudinal axis, a throttle grip having an outer peripheral gripping surface and attached to said steering tiller for rotation about said longitudinal axis between a first position and a second position, throttle linkage means operatively connected with said throttle grip and said throttle for moving said throttle between said idle position and said advanced position in response to movement of said throttle grip between said first position and said second position, an idle adjustment knob having an outer periphery and being carried by said throttle grip for rotation with and relative to said throttle grip with a portion of said outer periphery extending radially from said longitudinal axis and outwardly beyond said gripping surface, and means operatively connected said idle adjustment knob with said throttle linkage means for moving said throttle between said idle position and said advanced idle position in response to rotation of said idle adjustment knob relative to said throttle grip.

* * * * *